US008647169B2

(12) United States Patent
Chang

(10) Patent No.: US 8,647,169 B2
(45) Date of Patent: Feb. 11, 2014

(54) BACKLESS, STRAPLESS BRA AND ATTACHABLE BREAST FORM ENHANCEMENT SYSTEM

(75) Inventor: Kwo-Chaung Chang, Walnut, CA (US)

(73) Assignee: Bragel International, Inc., Pomona, CA (US)

( * ) Notice: Subject to any disclaimer, the term of this patent is extended or adjusted under 35 U.S.C. 154(b) by 136 days.

(21) Appl. No.: 13/027,225

(22) Filed: Feb. 14, 2011

(65) Prior Publication Data

US 2012/0208434 A1 Aug. 16, 2012

(51) Int. Cl.
*A41C 3/00* (2006.01)

(52) U.S. Cl.
USPC ..... 450/81; 450/38; 450/57

(58) Field of Classification Search
USPC ..... 450/36–38, 54–57; 2/267, 268; 623/7, 623/8; 604/385.01
See application file for complete search history.

(56) References Cited

U.S. PATENT DOCUMENTS

| | | | | |
|---|---|---|---|---|
| 2,310,082 | A * | 2/1943 | Holbrooke | 602/55 |
| 2,399,545 | A * | 4/1946 | Davis | 604/389 |
| 4,640,288 | A * | 2/1987 | Hattori | 450/81 |
| 5,104,396 | A * | 4/1992 | Oatley et al. | 604/379 |
| 5,326,305 | A * | 7/1994 | Fochler | 450/57 |
| 5,693,164 | A | 12/1997 | Chang | |
| 6,200,195 | B1 * | 3/2001 | Furuno et al. | 450/81 |
| 6,695,678 | B1 * | 2/2004 | Foley et al. | 450/57 |
| 6,758,720 | B2 | 7/2004 | Chen | |
| 6,780,081 | B2 | 8/2004 | Chen et al. | |
| 6,852,001 | B2 | 2/2005 | Chen et al. | |
| 6,857,932 | B2 | 2/2005 | Chen | |
| 6,857,935 | B1 * | 2/2005 | Dohan | 450/81 |
| 6,916,224 | B2 | 7/2005 | Chen et al. | |
| 7,044,828 | B2 * | 5/2006 | Foley et al. | 450/37 |
| 7,052,359 | B2 | 5/2006 | Chen et al. | |
| 7,144,296 | B2 | 12/2006 | Chen et al. | |
| 7,229,335 | B2 | 6/2007 | Davis | |
| 7,278,899 | B2 | 10/2007 | Davis | |
| 7,566,344 | B2 * | 7/2009 | Hansen | 623/7 |
| 7,677,952 | B2 | 3/2010 | Wooley | |
| 8,029,332 | B2 | 10/2011 | Nadsady et al. | |
| 8,371,902 | B2 | 2/2013 | Sherwood | |
| 2003/0089084 | A1 * | 5/2003 | Ausnit | 53/412 |

OTHER PUBLICATIONS

Canadian Office Action dated Feb. 26, 2013 of the corresponding Canadian Patent Application No. 2,739,261 (3 pages).

* cited by examiner

*Primary Examiner* — Gloria Hale
(74) *Attorney, Agent, or Firm* — Christie, Parker & Hale, LLP

(57) ABSTRACT

A bra cup or breast form including an interior surface facing toward a user's breast and having at least one thin ridge of pressure sensitive adhesive, for securing the bra cup or breast form to the user's breast, and at least one ventilation pathway on the interior surface. The bra cup or breast form may be used in a backless, strapless bra or breast form system.

37 Claims, 7 Drawing Sheets

BACKLESS, STRAPLESS BRA AND ATTACHABLE BREAST FORM ENHANCEMENT SYSTEM

FIELD OF THE INVENTION

Certain embodiments of the present invention relate to a bra cup having at least one thin ridge (or bead) of pressure sensitive adhesive, for adjoining the bra cup to the user's skin, and at least one ventilation pathway (or channel) on an interior surface of the bra cup. The bra cup may be used in a backless, strapless bra. Other embodiments of the present invention relate to a breast form having at least one thin ridge (or bead) of pressure sensitive adhesive, for adjoining the breast form to the user's skin, and at least one ventilation pathway (or channel) on an interior surface of the breast form. The breast form may be used in a backless, strapless breast form system.

BACKGROUND OF THE INVENTION

Various devices and methods are available to women who wish to enhance the appearance of their breasts. Generally, women can either undergo a surgical procedure to be fitted with breast implants, or can use some form of externally worn article to enhance the appearance of their breasts. To accommodate women wishing to avoid the dangers involved with surgical breast implants, several efforts have been made to provide externally worn articles that have the look and feel of natural breasts, yet are non-permanent and health-risk free. Such externally worn devices have included a wide range of foam pads, push-up bras, and gelled breast inserts to be worn between the user's breasts and a bra.

A key feature of such an externally worn article is that it look and feel natural so as to complement and not detract from the existing female breast that it is used to enhance. In addition to enhancing an existing breast, externally worn articles are designed to replace a female human breast that has been surgically removed. Externally worn articles that can be worn for the purpose of either enhancing or replacing human breasts are referred to as breast forms, and include a wide range of breast enhancers, breast inserts, and breast prostheses. A popular type of breast form has been made from a silicone gel material that is completely encased by plastic film material. The advantage of this type of breast form is that it looks like a natural human breast when worn and feels natural to the user, thus enhancing the self image and confidence of the user. Other breast forms, such as foam pads, water-filled pads and the like, may not afford the user these important qualities but, rather, may look unnatural and feel foreign.

In addition to the demand for devices and methods for enhancing breast size and shape, there is also a demand for being able to use those devices and methods while wearing a full-range of clothing. For example, women wearing a backless dress or a halter top will not want to wear a traditional bra. As a result, bras and breast form systems have been developed that are both backless and strapless. Such backless, strapless bras and breast form systems have used non-permanent adhesives, such as a disposable double-sided tape or a layer of adhesive, to secure the bra or breast form to the user. Backless, strapless bras and breast form systems having a layer of adhesive may inhibit the ventilation of air and/or moisture from the user's skin, which may result in excessive user perspiration and may lead to skin irritation. Additionally, manual application of a layer of adhesive to the bra cup or breast form may require the use of a barrier film to prevent the adhesive from soaking through the materials of the bra cup or breast form. The presence of the barrier film may further inhibit ventilation of the user's skin and further contribute to excessive perspiration and skin irritation. As a result, there is a need for a backless, strapless bra and breast form system that can be made without a barrier film and that can allow for ventilation of the user's skin.

SUMMARY

Embodiments of the present invention are directed to a bra cup or breast form having an interior surface facing toward a user's skin, at least one thin ridge (or bead) of pressure sensitive adhesive, for adjoining the bra cup or breast form to the user's skin, and at least one ventilation pathway (or channel) on the interior surface of the bra cup or breast form. The bra cup or breast form may be used in a backless, strapless bra or breast form system. The at least one thin ridge of pressure sensitive adhesive and at least one ventilation pathway may be interspersed on the interior surface of the bra cup or breast form. The portion of the interior surface of the bra cup or breast form that corresponds to the ventilation pathway may be substantially free from pressure sensitive adhesive, which may allow air and/or moisture to pass through the material of the bra cup or breast form. Alternatively, air and/or moisture may travel along the ventilation pathway (i.e., the portion of the interior surface of the bra cup or breast form that is substantially free from pressure sensitive adhesive) toward a peripheral edge of the bra cup or breast form, without passing through the material of the bra cup or breast form. By allowing air and/or moisture to pass through the material of the bra cup or breast form and/or by allowing air and/or moisture to travel along the ventilation pathway to the peripheral edge of the bra cup or breast form, the backless, strapless bras or breast form systems of the present invention allow air and/or moisture to be ventilated away from the user's skin. Ventilation of the user's skin may reduce the amount of user perspiration and skin irritation.

The at least one thin ridge of pressure sensitive adhesive may be arranged on the interior surface of the bra cup or breast form in a spiral pattern. Alternatively, the at least one thin ridge of pressure sensitive adhesive may include a plurality of thin ridges of pressure sensitive adhesive arranged in a pattern. A variety of patterns may be adopted. For example, the plurality of thin ridges of pressure sensitive adhesive may be arranged as concave arcs. In other embodiments of the present invention, the plurality of thin ridges of pressure sensitive adhesive are undulating thin ridges of pressure sensitive adhesive that extend vertically from the top of the interior surface of the bra cup or breast form to the bottom of the interior surface of the bra cup or breast form. The at least one thin ridge of pressure sensitive adhesive may be located adjacent to at least two separate sides of the at least one ventilation pathway and may be applied mechanically to the interior surface of the bra cup or breast form. In certain embodiments, the at least one thin ridge of pressure sensitive adhesive is applied mechanically by a computer numerical control machine that has at least 3-axes of movement. Additionally, mechanically applying the at least one thin ridge of pressure sensitive adhesive may also form the ventilation pathway (i.e., the portion of the interior surface of the bra cup or breast form that is substantially free from pressure sensitive adhesive).

DETAILED DESCRIPTION

Figure 1:
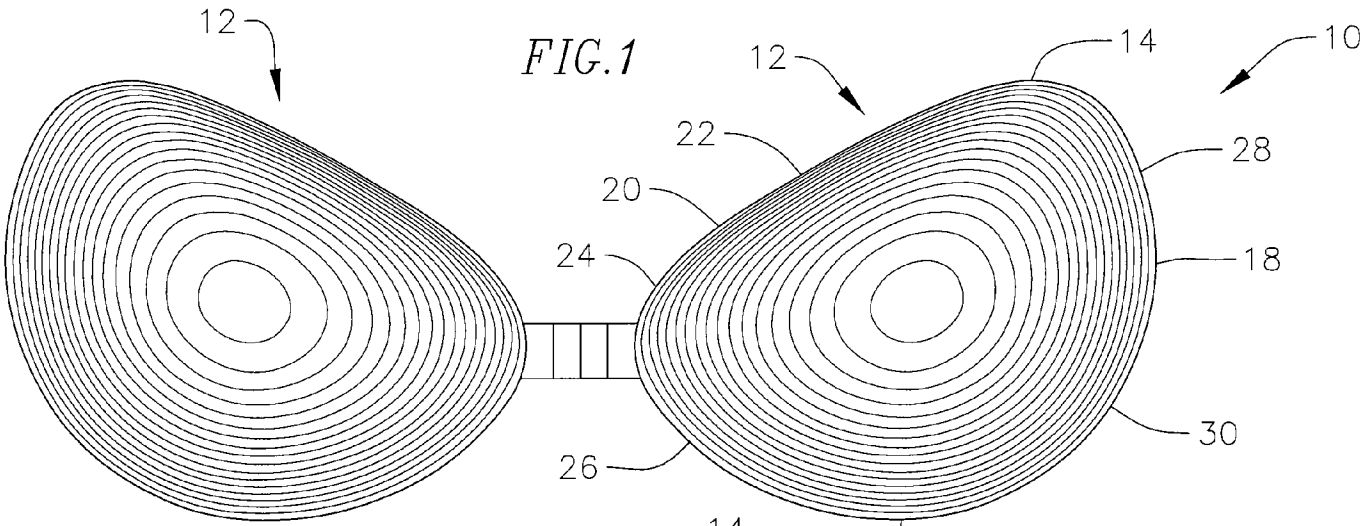
FIG. 1 is a front view of a bra or breast form system having a pair of bra cups or breast forms.

An improved backless, strapless bra cup or breast form system constructed according to embodiments of this invention, generally includes a pair of bra cups or breast forms, at least one of which has at least one thin ridge (or bead) of pressure sensitive adhesive and at least one ventilation pathway (or channel) on an interior surface of the bra cup or breast form. The bra cups or breast forms of the present invention may include a variety of suitable shapes, materials, and connectors, such as those described in U.S. Pat. Nos. 7,144,296; 7,052,359; 6,916,224; and 5,693,164, the entire contents of which are incorporated herein by reference. FIG. 1 illustrates a front view of a backless, strapless bra or breast form system 10 of this invention. The backless, strapless bra or breast form system 10 includes a pair of bra cups or breast forms 12. The bra cups or breast forms 12 are separate articles that are independently placed on a left and right breast of a user. Each of the bra cups or breast forms 12 normally has the same structure, except one is designed to support and enhance the left breast and the other is designed to support and enhance the right breast.

Figure 2:
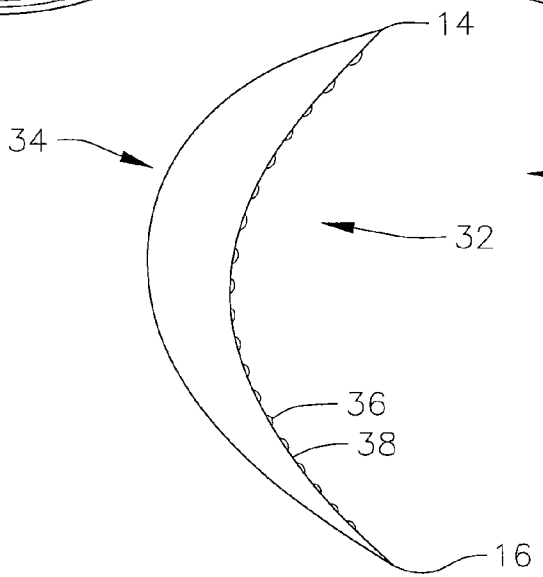
FIG. 2 is a side view of a bra cup or breast form.

A front view of the bra cups or breast forms 12 is shown in FIG. 1. Each bra cup or breast form 12 has a top 14, a bottom 16 opposite the top, an outer side 18, and an inner side 20 opposite the outer side. Each bra cup or breast form also defines an inner top 22, an inner middle 24, and an inner bottom 26. Additionally, each bra cup or breast form defines an outer top 28 and an outer bottom 30. Referring to FIG. 2, each bra cup or breast form 12 defines two surfaces relative to the user, an interior surface 32 facing toward the user's breasts, and an exterior surface 34 facing opposite the interior surface and away from the user's breasts. The interior surface 32 includes at least one thin ridge of pressure sensitive adhesive 36 that adjoins the breast forms to the user's skin and at least one ventilation pathway 38.

The at least one thin ridge of pressure sensitive adhesive 36 and the at least one ventilation pathway 38 may be interspersed on the interior surface 32 of the bra cup or breast form. The portion of the interior surface of the bra cup or breast form that corresponds to the ventilation pathway may be substantially free from pressure sensitive adhesive, which may allow air and/or moisture to pass through the material of the bra cup or breast form. Alternatively, air and/or moisture may travel along the ventilation pathway (i.e., the portion of the interior surface of the bra cup or breast form that may be substantially free from pressure sensitive adhesive) toward a peripheral edge of the bra cup or breast form, without passing through the material of the bra cup or breast form. By allowing air and/or moisture to pass through the material of the bra cup or breast form and/or by allowing air and/or moisture to travel along the ventilation pathway to the peripheral edge of the bra cup or breast form, the backless, strapless bras or breast form systems of the present invention allow air and/or moisture to be carried or ventilated away from the user's skin. Ventilation of the user's skin can reduce the amount of user perspiration and skin irritation.

In contrast to embodiments of the present invention, the adhesive layer of known backless, strapless bras or breast form systems forms a continuous layer of adhesive that inhibits the ventilation of air and/or moisture from the user's skin by inhibiting air and/or moisture from passing through the material of the bra cup or breast form and by inhibiting air and/or moisture from traveling to a peripheral edge of the bra cup or breast form. As a result, the continuous adhesive layer of known backless, strapless bras and breast form systems results in increased user perspiration and can cause skin irritation. Accordingly, the backless, strapless bra cup or breast form of the present invention, which allows air and/or moisture to pass through the material of the bra cup or breast form and/or allows air and/or moisture to travel along the ventilation pathway to the peripheral edge of the bra cup or breast form, may reduce user perspiration and skin irritation.

Furthermore, because the interior portion of the bra cup or breast form corresponding to the ventilation pathway is substantially free from pressure sensitive adhesive, the backless, strapless bras or breast forms of the present invention require less adhesive than conventional backless, strapless bras and breast form systems. Having at least one thin ridge of pressure sensitive adhesive and at least one ventilation pathway on an interior surface of the backless, strapless bras or breast forms of the present invention reduces the amount of adhesive required by as much as 70%. As a result, the backless, strapless bras or breast form systems of the present invention are lighter in weight than conventional bras or breast form systems. Additionally, reducing the amount of pressure sensitive adhesive can significantly reduce the cost of producing the backless, strapless bras or breast forms of the present invention. Indeed, the pressure sensitive adhesive may be the most expensive component of a backless, strapless bra or breast form system, and therefore, reducing the amount of pressure sensitive adhesive required may greatly reduce the cost of producing the backless, strapless bra or breast form system. In addition, the pressure sensitive adhesive, and its associated starting materials and byproducts, may present an environmental hazard. Therefore, reducing the amount of pressure sensitive adhesive used may reduce the environmental impact associated with producing the backless, strapless bras or breast form systems of the present invention.

The at least one thin ridge of pressure sensitive adhesive 36 can include any type of pressure sensitive adhesive that is suitable for removably attaching a bra cup or breast form to a user's skin, such as various types and forms of permanently applied pressure sensitive adhesives. The at least one thin ridge of pressure sensitive adhesive 36 is preferably a reusable pressure sensitive adhesive that is permanently applied to the interior surface 32 of each bra cup or breast form. For example, the pressure sensitive adhesive may be a silicone-based pressure sensitive adhesive. Additionally, the pressure sensitive adhesive may have a higher viscosity than conventional adhesives. According to embodiments of the present invention, the pressure sensitive adhesive may have a viscosity of more than or equal to about 15,000 centipoise when applied. That is, at the time the pressure sensitive adhesive is applied to the interior surface of the bra cup or breast form, the pressure sensitive adhesive may have a viscosity of more than or equal to about 15,000 centipoise. The at least one thin ridge of pressure sensitive adhesive is able to withstand tremendous movement and pressure from the user without slipping and can even be subjected to water or sweat without degeneration of the adhesive properties. In fact, if the thin ridge of pressure sensitive adhesive becomes dirty (i.e. collects unwanted particles such as dust, lint, or debris), it can be cleaned with soap and water to remove the unwanted particles and fully restore the adhesive properties.

The at least one thin ridge of pressure sensitive adhesive 36 allows the user to place each of the bra cups or breast forms at a position on the user's breasts that will create a desired shape and look of the breasts. The amount and type of pressure sensitive adhesive comprising the at least one thin ridge of pressure sensitive adhesive 36 can vary, as can the portions of the interior surface that have the at least one thin ridge of pressure sensitive adhesive. Various factors can contribute to the amount, type, and placement of the at least one thin ridge of pressure sensitive adhesive such as the size, shape, and weight of the bra cup or breast form.

The at least one thin ridge of pressure sensitive adhesive may be in the form of a band (or bead) of pressure sensitive adhesive having a length extending along the interior surface of the bra cup or breast form that is longer than the width of the thin ridge. The width of the at least one thin ridge of pressure sensitive adhesive may be unchanging or the width may vary. Additionally, the at least one thin ridge of pressure sensitive adhesive may be formed as a continuous ridge, or it may include discontinuities. The at least one thin ridge of pressure sensitive adhesive may also be arranged on the interior surface of the bra cup or breast form in a pattern. For example, the at least one thin ridge of pressure sensitive adhesive may be arranged in a spiral pattern on the interior surface of the bra cup or breast form. Any suitable spiral pattern or variation of a spiral pattern may be used. The spiral pattern may be a three-dimensional spiral pattern, such as a conic spiral pattern, conic helix pattern, or spherical spiral pattern, or any suitable variation thereof. Additionally, any suitable three-dimensional variation of a two-dimensional spiral pattern, such as an Archimedean, Fermat, Theodorus, hyperbolic, lituus, or logarithmic spiral pattern, may be used. The present invention is not particularly limited by the type or shape of the spiral pattern.

Figure 3A:
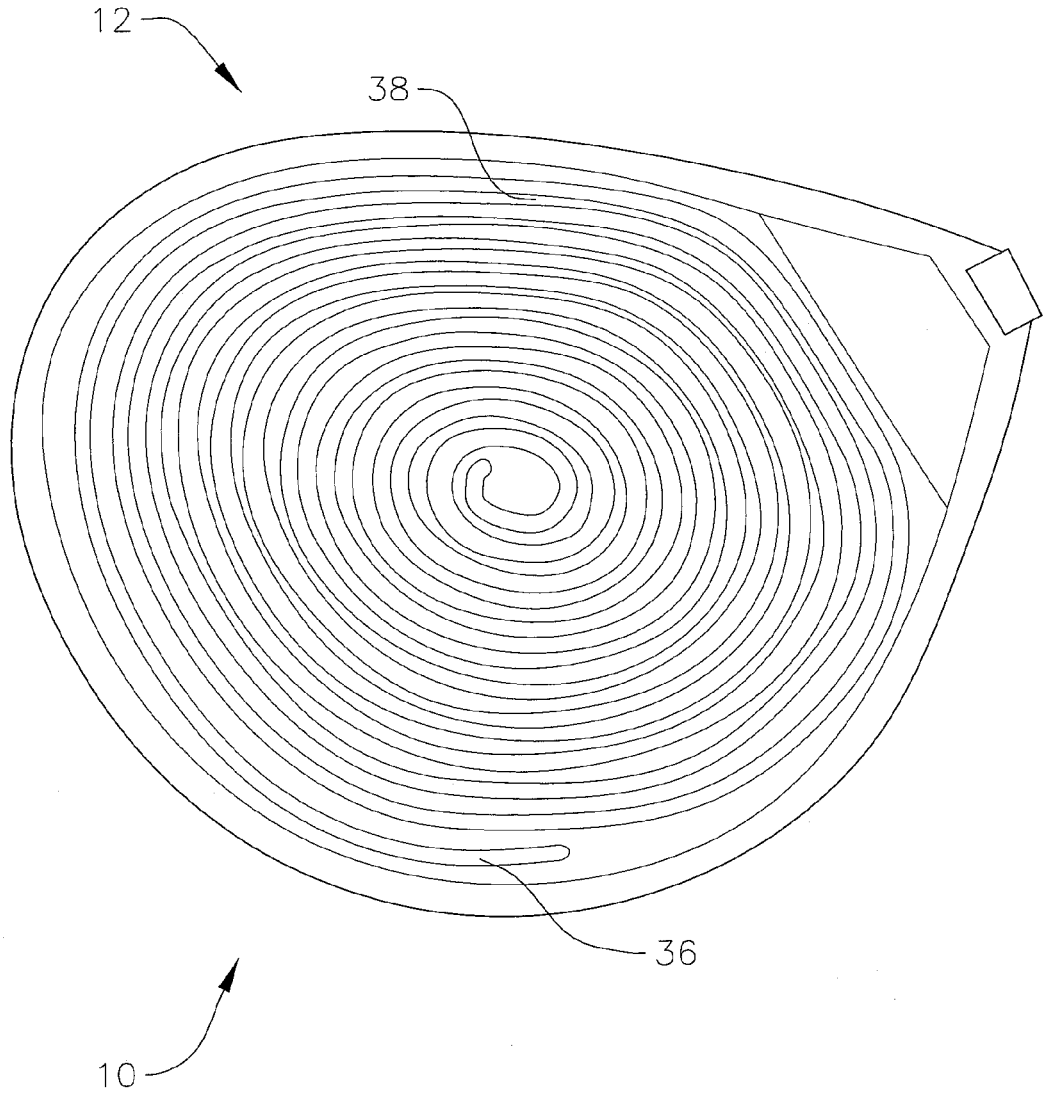
FIG. 3*a* is a back view of a bra cup or breast form having at least one thin ridge of pressure sensitive adhesive arranged in a spiral pattern.

As can be seen in FIG. 3*a*, the at least one thin ridge of pressure sensitive adhesive may be arranged in a spiral pattern that emanates from the center of the interior surface of the bra cup or breast form to a peripheral edge of the interior surface of the bra cup or breast form. The spiral pattern may be viewed as a right-handed or left-handed spiral pattern, and the present invention is not particularly limited by the handedness of the spiral pattern. For example, the backless, strapless bra or breast form system of the present invention may include a pair of bra cups or breast forms, wherein both bra cups or both breast forms have a right-handed spiral pattern. Alternatively, the backless, strapless bra or breast form system of the present invention may include a pair of bra cups or breast forms, wherein both bra cups or both breast forms have a left-handed spiral pattern. As an additional alternative, the backless, strapless bra or breast form system of the present invention may include a pair of bra cups or breast forms, wherein one bra cup or breast form has a right-handed spiral pattern and the other bra cup or breast form has a left-handed spiral pattern.

Portions of the spiral pattern (e.g., the start and/or end portions of the spiral pattern) may intersect other portions of the spiral pattern. That is, certain sections of the spiral pattern may overlap with, or crossover, other sections of the spiral pattern without deviating from the spirit of the present invention. For example, the end section of the spiral pattern may overlap with, or crossover, a central section or sections of the spiral pattern. Alternatively, the spiral pattern may be free from any intersecting portions. For example, the spiral pattern may be free of any sections that overlap with, or crossover, other sections of the spiral pattern.

Figure 3B:
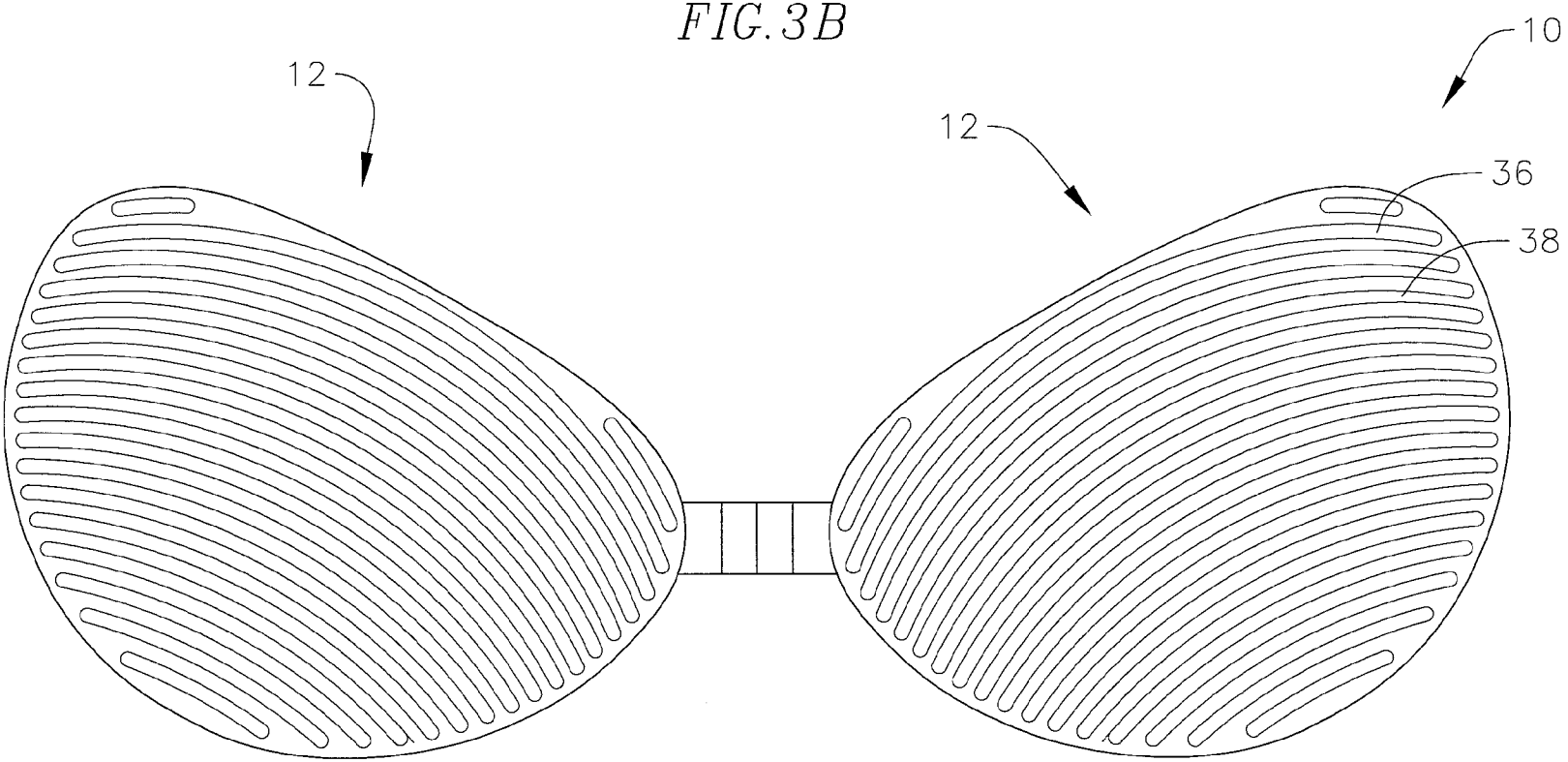
FIG. 3*b* is a back view of a bra or breast form system having a pair of bra cups or breast forms having a plurality of thin ridges of pressure sensitive adhesive arranged as concave arcs.

In another embodiment of the present invention, the at least one thin ridge of pressure sensitive adhesive includes a plurality of thin ridges of pressure sensitive adhesive. The plurality of thin ridges of pressure sensitive adhesive may extend substantially horizontally across the interior surface of the bra cup or breast form. That is, the plurality of thin ridges of pressure sensitive adhesive may extend substantially horizontally from the outer side 18 to the inner side 20 of the bra cup or breast form 12. For example, the plurality of thin ridges of pressure sensitive adhesive can be arranged as concave arcs. The concave arcs may extend substantially horizontally from the outer side 18 to the inner side 20 of the bra cup or breast form 12. As can be seen in FIG. 3*b*, the concave arcs may have a "concave down" arrangement, in which the concave portion of the arc faces down toward the bottom 16 and the convex portion of the arc faces up toward the top 14 of the bra cup or breast form 12. Additionally, the plurality of thin ridges of pressure sensitive adhesive may be intersecting or non-intersecting.

Figure 3C:
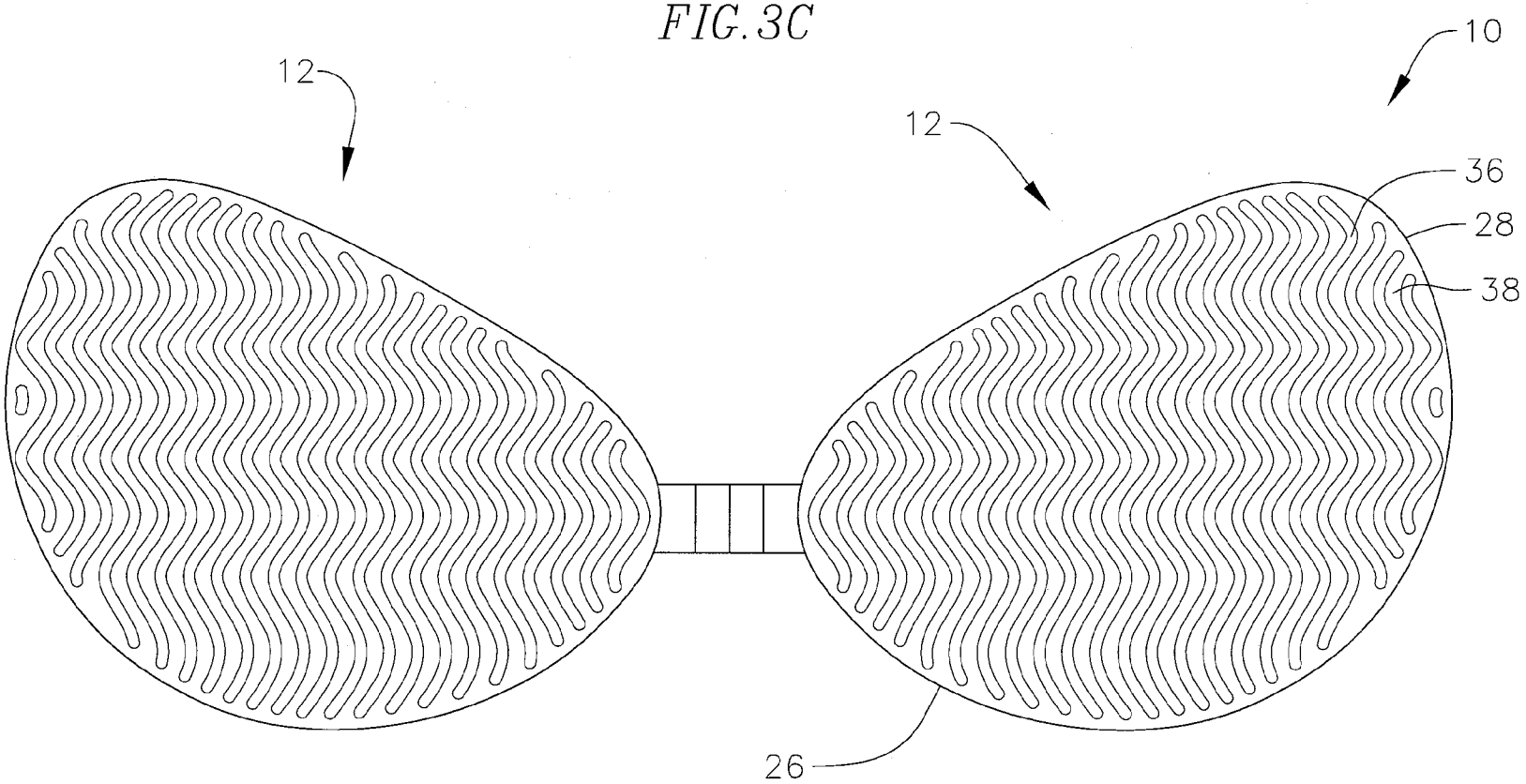
FIG. 3*c* is a back view of a bra or breast form system having a pair of bra cups or breast forms having a plurality of thin ridges of pressure sensitive adhesive arranged as undulating vertical ridges.

In yet another embodiment, the plurality of thin ridges of pressure sensitive adhesive may extend substantially vertically across the interior surface of the bra cup or breast form. That is, the plurality of thin ridges may extend substantially vertically from the bottom 16 to the top 14 of the bra cup or breast form 12. For example, the plurality of thin ridges of pressure sensitive adhesive can be arranged as undulating vertical ridges. The undulation of the vertical ridges may be formed by varying the direction along which the at least one thin ridge of pressure sensitive adhesive extends across the interior surface of the bra cup or breast form. Alternatively, the undulation of the vertical ridges may be formed by varying the width of the at least one thin ridge of pressure sensitive adhesive. Further, the undulation of the vertical ridges may be formed by varying both the direction along which the at least one thin ridge of pressure sensitive adhesive extends across the interior surface of the bra cup or breast form and the width of the at least one thin ridge of pressure sensitive adhesive. As can be seen in FIG. 3*c* the undulating vertical ridges may extend substantially vertically from the bottom 16 to the top 14 of the bra cup or breast form 12. Alternatively, the plurality of thin ridges of pressure sensitive adhesive may be arranged as substantially straight vertical ridges. The substantially straight vertical ridges may extend vertically from the bottom 16 to the top 14 of the bra cup or breast form 12. Additionally, the plurality of thin ridges of pressure sensitive adhesive may be intersecting or non-intersecting.

Figure 3D:
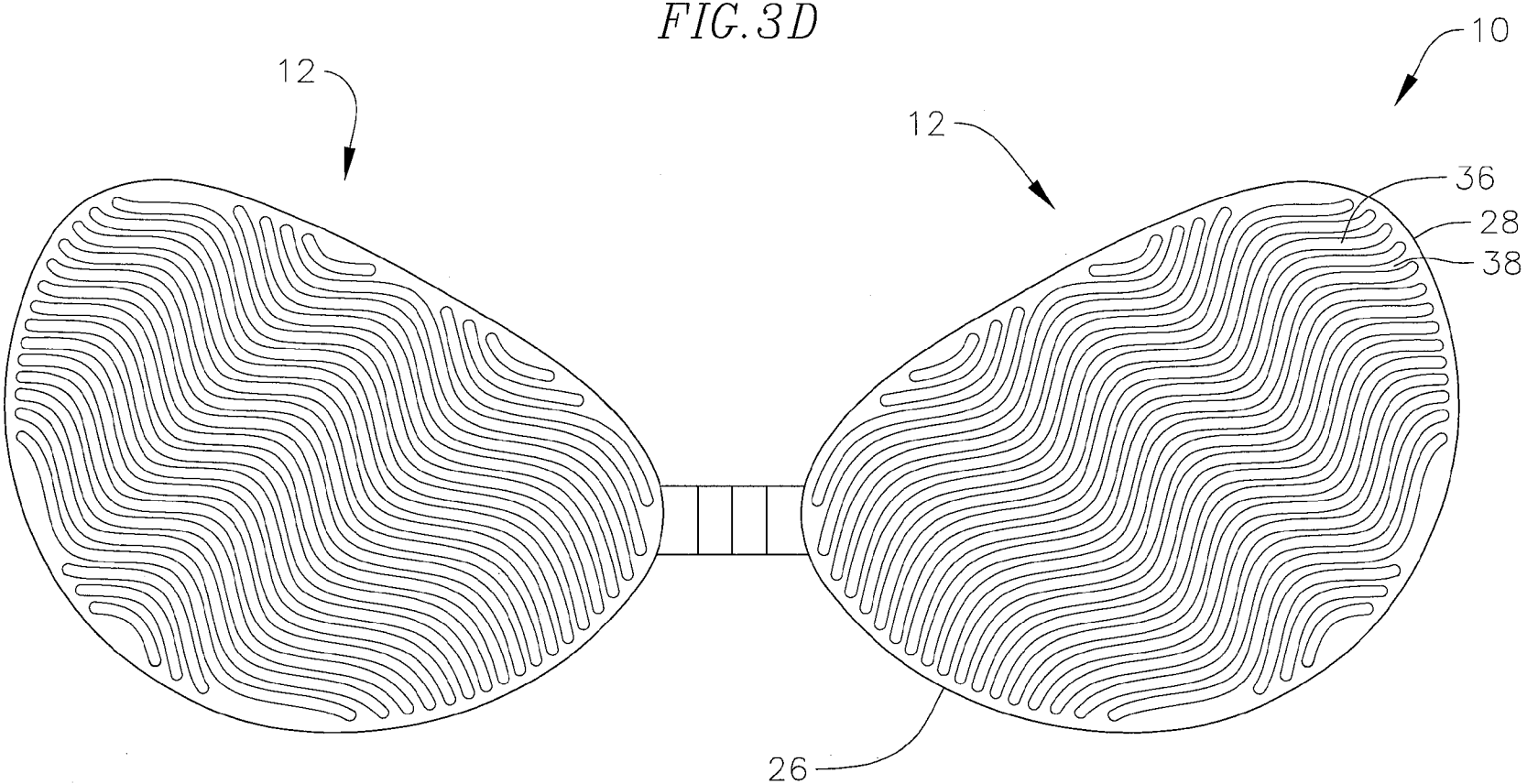
FIG. 3*d* is a back view of a bra or breast form system having a pair of bra cups or breast forms having a plurality of thin ridges of pressure sensitive adhesive arranged as undulating diagonal ridges.

In still another embodiment, the plurality of thin ridges of pressure sensitive adhesive may extend substantially diagonally across the interior surface of the bra cup or breast form. That is, the plurality of thin ridges of pressure sensitive adhesive may extend substantially diagonally from the inner top 22 to the outer bottom 30 of the bra cup or breast form 12, as shown in FIG. 3*d*. Alternatively, the plurality of thin ridges of pressure sensitive adhesive may extend substantially diagonally from the outer top 28 to the inner bottom 26 of the bra cup or breast form 12. Indeed, any combination of thin ridges of pressure sensitive adhesive extending substantially diagonally across the interior surface of the bra cup or breast form may be adopted. Additionally, the plurality of thin ridges of pressure sensitive adhesive may be intersecting or non-intersecting.

Figure 3E:
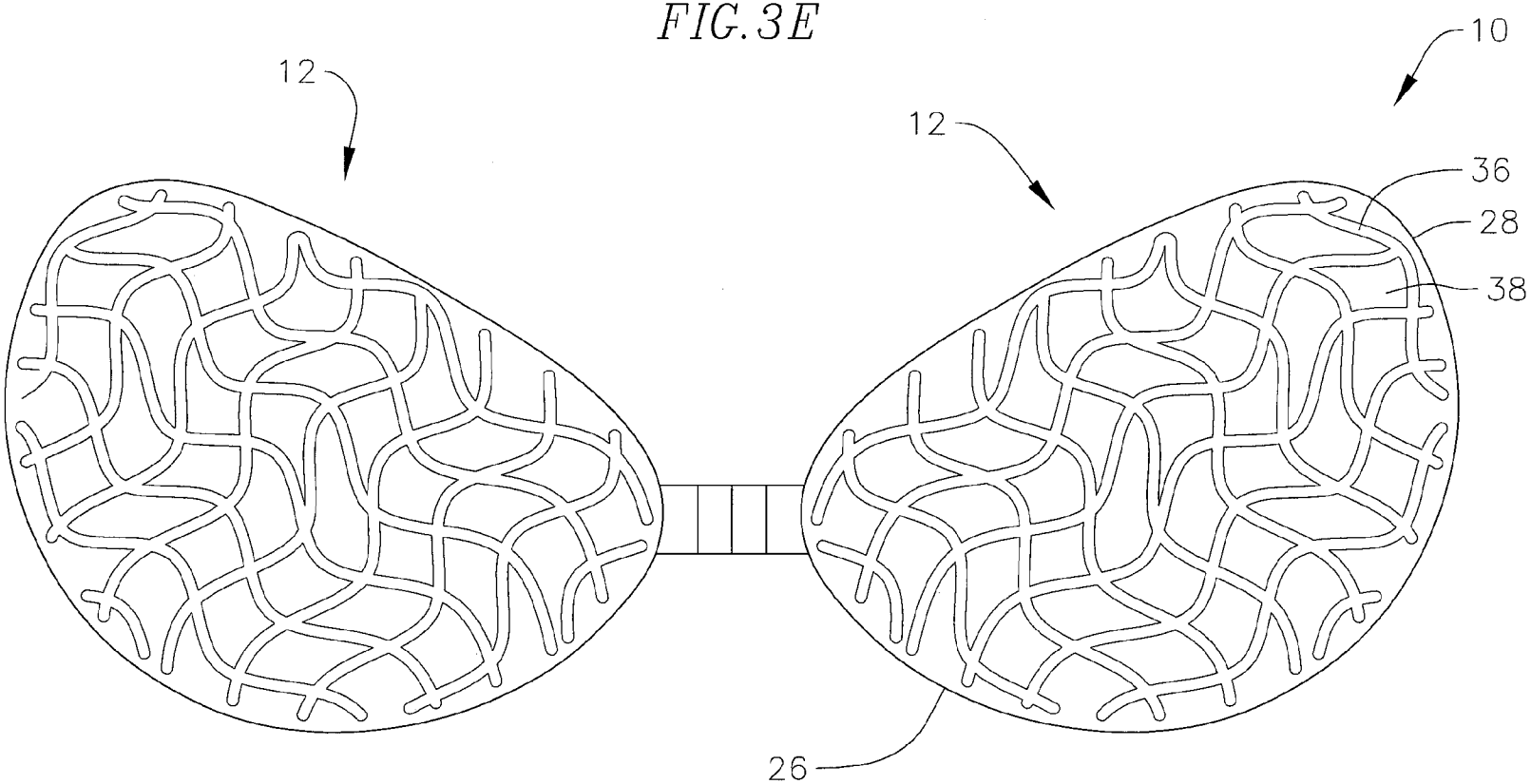
FIG. 3*e* is a back view of a bra or breast form system having a pair of bra cups or breast forms having a plurality of thin ridges of pressure sensitive adhesive arranged in a cross-hatch pattern.

In certain embodiments, the backless, strapless bra or breast form system of the present invention may include a plurality of intersecting thin ridges of pressure sensitive adhesive. That is, the bra cups or breast forms may include any combination of the above-described thin ridges of pressure sensitive adhesive, including those in which one or more of the thin ridges of pressure sensitive adhesive intersect one or more of the thin ridges of pressure sensitive adhesive. For example, as shown in FIG. 3*e*, at least one of the bra cups or breast forms may include a plurality of thin ridges of pressure sensitive adhesive arranged in a cross-hatch pattern.

Figure 4:
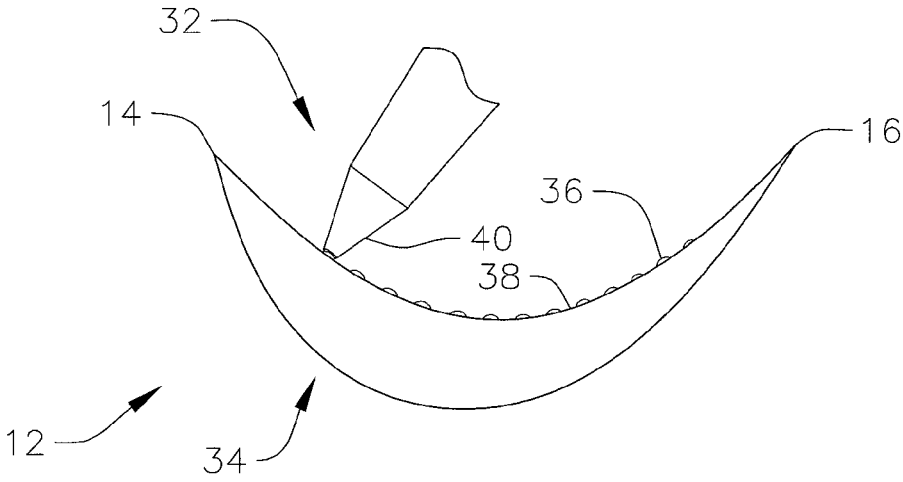
FIG. 4 is a side view of a bra cup or breast form that illustrates the mechanical application of at least one thin ridge of pressure sensitive adhesive to an interior surface of a bra cup or breast form.
Figure 5:
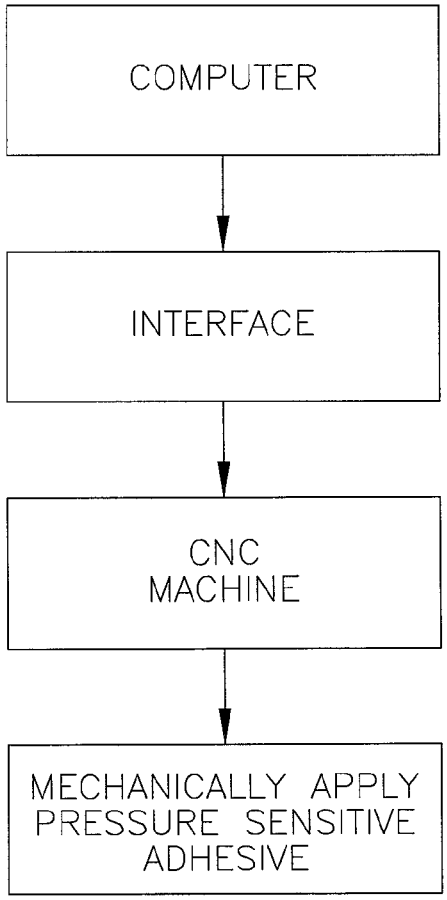
FIG. 5 is a block diagram that exemplifies a general process by which a pressure sensitive adhesive can be mechanically applied to an interior surface of a bra cup or breast form.

According to embodiments of the present invention, the at least one thin ridge of pressure sensitive adhesive may be applied mechanically to the interior surface of the bra cups or breast forms. For example, the at least one thin ridge of pressure sensitive adhesive may be applied mechanically using a machine under computer numerical control, also known as a CNC machine. FIG. 4 shows an example of a nozzle 40 mechanically applying a pressure sensitive adhesive to an interior surface of a bra cup or breast form. Additionally, FIG. 5 shows a block diagram that exemplifies a general process by which a pressure sensitive adhesive can be mechanically applied to an interior surface of a bra cup or breast form.

By mechanically applying the pressure sensitive adhesive, the pressure sensitive adhesive may be positioned more accurately, and may be applied more quickly and with less pressure than is possible with conventional methods. Conventional adhesive layers are applied manually as a continuous layer. Manual application of the adhesive is a time consuming process that introduces the potential for contamination of the adhesive. Additionally, manual application of the adhesive is limited in its ability to provide patterns of adhesive, as the positioning of the adhesive can be difficult to control. Indeed, conventional manual application of typical adhesives may not be capable of preparing the at least one thin ridge of pressure sensitive adhesive of embodiments of the present invention. Moreover, in applying the adhesive by hand, pressure is exerted on the adhesive, which can cause the adhesive to soak through the materials of the bra cups or breast forms. Consequently, conventional bra cups and breast forms, in which the adhesive is manually applied, typically require a barrier film to prevent the manually applied adhesive from soaking through the materials of the bra cups and breast forms. The presence of the barrier film in conventional bra cups and breast forms further inhibits ventilation of air and/or moisture from the user's skin, and as a result, can increase the amount of user perspiration and potentially cause skin irritation.

Mechanically applying the pressure sensitive adhesive according to embodiments of the present invention provides more accurate positioning, which allows the pressure sensitive adhesive to be applied as at least one thin ridge of pressure sensitive adhesive rather than a continuous layer of adhesive. As a result, the pressure sensitive adhesive can be applied in any suitable pattern, such as any of the above-described patterns (e.g., a spiral pattern, a plurality of concave arcs, a plurality of substantially vertical ridges, etc.). In addition, mechanically applying the pressure sensitive adhesive to the interior surface of the bra cup or breast form as at least one thin ridge of pressure sensitive adhesive allows the interior surface of the bra cup or breast form to also include at least one ventilation pathway. That is, by patterning the pressure sensitive adhesive as at least one thin ridge of pressure sensitive adhesive, the interior surface of the bra cup or breast form can also have patterned portions that are substantially free of pressure sensitive adhesive, thereby forming the at least one ventilation pathway. Therefore, mechanically applying the at least one thin ridge of pressure sensitive adhesive may also form the at least one ventilation pathway. Accordingly, in certain embodiments, there is a thin ridge of pressure sensitive adhesive located on either side of the at least one ventilation pathway.

In certain embodiments of the present invention, the pressure sensitive adhesive is mechanically applied by a machine, such as a CNC machine. The CNC machine may have at least 3-axes movement. In certain embodiments, the machine for applying the pressure sensitive adhesive is a CNC machine having at least 4-axes of movement. In still other embodiments of the present invention, the machine for applying the pressure sensitive adhesive is a CNC machine having at least 5-axes of movement.

The method of preparing backless, strapless bras or breast forms may also include curing the pressure sensitive adhesive. For example, the method according to embodiments of the present invention may include curing the pressure sensitive adhesive for about 15 minutes. Alternatively, the method may include curing the pressure sensitive adhesive for less than 15 minutes. While curing, the pressure sensitive adhesive may be able to flow across the interior surface of the bra cup or breast form, or it may be able to soak into (or through) the material of the bra cup or breast form. If the pressure sensitive adhesive flows across the interior surface of the bra cup or breast form, it may undesirably distort the shape of the at least one thin ridge of pressure sensitive adhesive, or it may inhibit the formation of the at least one ventilation pathway. Further, if the pressure sensitive adhesive soaks into (or through) the material of the bra cup or breast form, it may undesirably increase the need for a barrier film. By using a pressure sensitive adhesive able to cure in less than or equal to about 15 minutes, embodiments of the present invention reduce the opportunity for the pressure sensitive adhesive to flow across or soak into (or through) the material of the bra cup or breast form. Thus, certain embodiments of the present invention may preserve the shape of the at least one thin ridge of pressure sensitive adhesive and may reduce the need for a barrier film. The present invention is not, however, limited by the curing time of the pressure sensitive adhesive.

By mechanically applying the pressure sensitive adhesive to the interior surface of the bra cup or breast form, the at least one thin ridge of pressure sensitive adhesive and at least one ventilation pathway can be interspersed on the interior surface of the bra cup or breast form. By including at least one thin ridge of pressure sensitive adhesive and at least one ventilation pathway, the bra cups or breast forms of embodiments of the present invention allow air and/or moisture to be ventilated away from the user's skin, thereby decreasing the amount of the user's perspiration, which may reduce or avoid user skin irritation. Mechanical application of the pressure sensitive adhesive also reduces the potential for contamination that is created by manual application of the pressure sensitive adhesive. Additionally, mechanically applying the pressure sensitive adhesive reduces the labor costs associated with producing bras and breast form systems.

Furthermore, mechanically applying the pressure sensitive adhesive allows the pressure sensitive to be applied with less pressure than is used in manual application. Mechanical application of the pressure sensitive adhesive also allows the use of a higher viscosity pressure sensitive adhesive. That is, at the time the pressure sensitive adhesive is applied to the interior surface of the bra cup or breast form, the pressure sensitive adhesive may have a higher viscosity than conventional adhesives. For example, a pressure sensitive adhesive having a viscosity of more than or equal to about 15,000 centipoise may be used, such as a pressure sensitive adhesive having a viscosity equal to about 15,000 centipoise or a pressure sensitive adhesive having a viscosity equal to more than 15,000 centipoise. Additionally, the pressure sensitive adhesive may be a silicone-based adhesive. By mechanically applying the pressure sensitive adhesive with less pressure and/or by using a pressure sensitive adhesive having a higher viscosity, the amount of pressure sensitive adhesive that may soak through the material of the bra cup or breast form is reduced. Pressure sensitive adhesives having a viscosity of less than about 15,000 centipoise, when applied, may be able to flow across the interior surface of the bra cup or breast form, or they may be able to soak into (or through) the material of the bra cup or breast form. If the pressure sensitive adhesive flows across the interior surface of the bra cup or breast form, it may undesirably distort the shape of the at least one thin ridge of pressure sensitive adhesive, or it may inhibit the formation of the at least one ventilation pathway. Further, if the pressure sensitive adhesive soaks into (or through) the material of the bra cup or breast form, it may undesirably increase the need for a barrier film. By using a pressure sensitive adhesive having a viscosity more than or equal to about 15,000 centipoise, embodiments of the present invention may reduce the opportunity for the pressure sensitive adhesive to flow across or soak into (or through) the material of the bra cup or breast form. Thus, certain embodiments of the present invention may preserve the shape of the at least one thin ridge of pressure sensitive adhesive and may reduce the need for a barrier film. Accordingly, embodiments of the present invention do not require a barrier film to prevent the pressure sensitive adhesive from soaking through the material of the bra cups or breast forms. Indeed, in certain embodiments of the present invention, the bra cups or breast forms do not include a barrier film.

According to embodiments of the present invention, the bra or breast form system 10 can be formed from several different types of bra cups or breast forms 12. The bra cups or breast forms 12 are intended to include all types of externally worn articles that can be worn to enhance or replace a user's breasts. These include, but are not limited to, bra cups or breast forms made from a volume of silicone gel encased by a thermoplastic film material. The bra cups or breast forms also include any liquid, air, or gel encased by any foam, plastic, rubber, fabric, or molded unwoven fiber material, as well as any solid material that is suitable for external breast enhancement, such as a foam, soft rubber, fabric, molded unwoven fiber, or plastic. Accordingly, it is understood that a wide range of materials, structures, and sizes are within the scope of the bra cups or breast forms 12 for purposes of this invention.

In addition to the specific features and embodiments described above, it is understood that the present invention includes all equivalents to the structures and systems described herein, and is not to be limited to the disclosed embodiments. Individuals skilled in the art to which the present breast form enhancement system pertains will understand that variations and modifications to the embodiments described can be used beneficially without departing from the scope of the invention.

What is claimed is:

1. A bra cup comprising:

an interior surface of the bra cup configured to be placed on a breast of a user and to face toward the user's breast; and a pattern formed by interspersing at least one thin ridge of pressure sensitive adhesive on the interior surface of the bra cup for securing the bra cup to the user's breast and at least one ventilation pathway on the interior surface of the bra cup at two sides of the at least one thin ridge of pressure sensitive adhesive, the ventilation pathway corresponding to a portion of the interior surface of the bra cup comprising a material that is free from pressure sensitive adhesive and allows moisture to pass through the material, and the pattern extending across the entire interior surface of the bra cup.

2. The bra cup of claim 1, wherein the pattern is a spiral pattern.

3. The bra cup of claim 1, wherein the at least one thin ridge of pressure sensitive adhesive comprises a plurality of thin ridges of pressure sensitive adhesive.

4. The bra cup of claim 3, wherein the plurality of thin ridges of pressure sensitive adhesive are arranged on the interior surface of the bra cup as concave arcs having a concave portion facing toward a bottom of the bra cup.

5. The bra cup of claim 3, wherein the plurality of thin ridges of pressure sensitive adhesive are undulating thin ridges of pressure sensitive adhesive that extend vertically from a top of the interior surface to a bottom of the interior surface.

6. The bra cup of claim 1, wherein the at least one thin ridge of pressure sensitive adhesive is located adjacent to at least two separate sides of the at least one ventilation pathway.

7. The bra cup of claim 1, wherein the at least one thin ridge of pressure sensitive adhesive comprises a pressure sensitive adhesive having a viscosity of more than or equal to about 15,000 centipoise when applied.

8. The bra cup of claim 1, wherein the at least one thin ridge of pressure sensitive adhesive cures in less than or equal to about 15 minutes.

9. The bra cup of claim 1, wherein the at least one ridge of pressure sensitive adhesive comprises a silicone-based pressure sensitive adhesive.

10. A backless, strapless bra comprising the bra cup of claim 1.

11. A breast form comprising:

an interior surface of the breast form configured to be placed on a breast of a user and to face toward the user's breast; and a pattern formed by interspersing at least one thin ridge of pressure sensitive adhesive on the interior surface of the breast form for securing the breast form to the user's breast and at least one ventilation pathway on the interior surface of the breast form at two sides of the at least one thin ridge of pressure sensitive adhesive, the ventilation pathway corresponding to a portion of the interior surface of the breast form comprising a material that is free from pressure sensitive adhesive and allows moisture to pass through the material, and the pattern extending across the entire interior surface of the breast form.

12. The breast form of claim 11, wherein the pattern is a spiral pattern.

13. The breast form of claim 11, wherein the at least one thin ridge of pressure sensitive adhesive comprises a plurality of thin ridges of pressure sensitive adhesive.

14. The breast form of claim 13, wherein the plurality of thin ridges of pressure sensitive adhesive are arranged on the interior surface of the breast form as concave arcs having a concave portion facing toward a bottom of the breast form.

15. The breast form of claim 13, wherein the plurality of thin ridges of pressure sensitive adhesive are undulating thin ridges of pressure sensitive adhesive that extend vertically from a top of the interior surface to a bottom of the interior surface.

16. The breast form of claim 11, wherein the at least one thin ridge of pressure sensitive adhesive is located adjacent to at least two separate sides of the at least one ventilation pathway.

17. The breast form of claim 11, wherein the at least one thin ridge of pressure sensitive adhesive comprises a pressure sensitive adhesive having a viscosity of more than or equal to about 15,000 centipoise when applied.

18. The breast form of claim 11, wherein the at least one thin ridge of pressure sensitive adhesive cures in less than or equal to about 15 minutes.

19. The breast form of claim 11, wherein the at least one ridge of pressure sensitive adhesive comprises a silicone-based pressure sensitive adhesive.

20. A backless, strapless breast form system to be worn in place of a traditional bra, comprising the breast form of claim 11.

21. A method of preparing a bra cup comprising:

mechanically applying at least one thin ridge of pressure sensitive adhesive to an interior surface of a bra cup to form a ventilation pathway corresponding to a portion of the interior surface of the bra cup comprising a material that is free from pressure sensitive adhesive and allows moisture to pass through the material, wherein the at least one thin ridge of pressure sensitive adhesive and the ventilation pathway are interspersed to form a pattern extending across the entire interior surface of the bra cup, the at least one ventilation pathway is at two sides of the at least one thin ridge of pressure sensitive adhesive, and the interior surface is configured to be placed on a breast of a user and to face toward the user's breast.

22. The method of claim 21, wherein mechanically applying the at least one thin ridge of pressure sensitive adhesive to the interior surface of the bra cup comprises mechanically applying the pressure sensitive adhesive with a machine under computer numerical control.

23. The method of claim 22, wherein the machine has at least 3-axes of movement.

24. The method of claim 21, wherein the pattern is a spiral pattern, and the method further comprises mechanically applying the at least one thin ridge of pressure sensitive adhesive in the spiral pattern.

25. The method of claim 21, further comprising mechanically applying the at least one thin ridge of pressure sensitive adhesive as a plurality of thin ridges of pressure sensitive adhesive arranged on the interior surface of the bra cup as concave arcs having a concave portion facing toward a bottom of the bra cup.

26. The method of claim 21, further comprising mechanically applying the at least one thin ridge of pressure sensitive adhesive as a plurality of undulating thin ridges of pressure sensitive adhesive that extend vertically from a top of the interior surface to a bottom of the interior surface.

27. The method of claim 21, further comprising curing the at least one thin ridge of pressure sensitive adhesive for less than or equal to about 15 minutes.

28. A backless, strapless bra comprising the bra cup prepared according to the method of claim 21.

29. A method of preparing a breast form comprising:

mechanically applying at least one thin ridge of pressure sensitive adhesive to an interior surface of a breast form to form a ventilation pathway corresponding to a portion of the interior surface of the breast form comprising a material that is free from pressure sensitive adhesive and allows moisture to pass through the material, wherein the at least one thin ridge of pressure sensitive adhesive and the ventilation pathway are interspersed to form a pattern extending across the entire interior surface of the breast form, the at least one ventilation pathway is at two sides of the at least one thin ridge of pressure sensitive adhesive, and the interior surface is configured to be placed on a breast of a user and to face toward the user's breast.

30. The method of claim 29, wherein mechanically applying the at least one thin ridge of pressure sensitive adhesive to the interior surface of the breast form comprises mechanically applying the pressure sensitive adhesive with a machine under computer numerical control.

31. The method of claim 30, wherein the machine has at least 3-axes of movement.

32. The method of claim 29, wherein the pattern is a spiral pattern, and the method further comprises mechanically applying the at least one thin ridge of pressure sensitive adhesive in the spiral pattern.

33. The method of claim 29, further comprising mechanically applying the at least one thin ridge of pressure sensitive adhesive as a plurality of thin ridges of pressure sensitive adhesive arranged on the interior surface of the breast form as concave arcs having a concave portion facing toward a bottom of the breast form.

34. The method of claim 29, further comprising mechanically applying the at least one thin ridge of pressure sensitive adhesive as a plurality of undulating thin ridges of pressure sensitive adhesive that extend vertically from a top of the interior surface to a bottom of the interior surface.

35. The method of claim 29, further comprising curing the at least one thin ridge of pressure sensitive adhesive for less than or equal to about 15 minutes.

36. A backless, strapless breast form system to be worn in place of a traditional bra, comprising the breast form prepared according to the method of claim 29.

37. A bra cup comprising:

an interior surface of the bra cup configured to be placed on and cover a breast of a user and to face toward the user's breast; and a pattern formed by interspersing at least one thin ridge of pressure sensitive adhesive on a first portion of the interior surface of the bra cup for securing the bra cup to the user's breast and at least one ventilation pathway on a second portion of the interior surface of the bra cup at two sides of the at least one thin ridge of pressure sensitive adhesive, the second portion of the interior surface of the bra cup comprising a material that is free from pressure sensitive adhesive and allows moisture to pass through the material, and the pattern extending across the entire interior surface of the bra cup.

* * * * *